US006404396B1

(12) United States Patent
Hung et al.

(10) Patent No.: US 6,404,396 B1
(45) Date of Patent: Jun. 11, 2002

(54) DISMANTLING-TYPE ANTENNA, WITH CAPACITIVE LOAD, OF WHIP TYPE, AND METHOD OF MANUFACTURING A RADIATING SEGMENT OF SUCH AN ANTENNA

(75) Inventors: Frederic Ngo Bui Hung, Franconville; Claire Dassonville, Paris, both of (FR)

(73) Assignee: Thomson-CSF, Paris (FR)

( * ) Notice: Subject to any disclaimer, the term of this patent is extended or adjusted under 35 U.S.C. 154(b) by 0 days.

(21) Appl. No.: 09/936,180

(22) Filed: Sep. 10, 2001

(30) Foreign Application Priority Data

Mar. 12, 1999 (FR) ..... 99 03092

(51) Int. Cl.[7] ..... H01Q 3/24
(52) U.S. Cl. ..... 343/749; 343/722
(58) Field of Search ..... 343/749, 900, 343/876, 745, 750, 752, 792, 722, 860

(56) References Cited

U.S. PATENT DOCUMENTS 4,229,743 A * 10/1980 Vo et al. ..... 343/749
4,890,116 A * 12/1989 Lewis, Jr. ..... 343/749
5,977,920 A 11/1999 Hung ..... 343/876
6,195,065 B1 * 2/2001 Hung et al. ..... 343/876

* cited by examiner

*Primary Examiner*—Tho Phan
*Assistant Examiner*—James Clinger
(74) *Attorney, Agent, or Firm*—Oblon, Spivak, McClelland, Maier & Neustadt, P.C.

(57) ABSTRACT

The invention concerns detachable whip antennae with capacitive load wherein the load does not need to contribute to the antenna mechanical strength. To achieve this, the entire load (3) is inserted in the conductor strand **(2*f*-21-33-32-2*n*) of a radiating segment of the antenna, the mechanical strength being provided by a hollow plastic insulating tube (20) reinforced with glass fibres, which acts as support for the conductor strand and as housing for the load and said load consists of a metal enclosure (33) wherein penetrates the insulated part of an electric cable (32)**.

The invention is particularly applicable to whip antennae designed for mobile stations.

7 Claims, 6 Drawing Sheets

DISMANTLING-TYPE ANTENNA, WITH CAPACITIVE LOAD, OF WHIP TYPE, AND METHOD OF MANUFACTURING A RADIATING SEGMENT OF SUCH AN ANTENNA

The invention relates to a dismantling-type antenna with a capacitive load, of whip type, known as a whip antenna; such an antenna, whether it can be dismantled or not, features a wide band of operating frequencies.

It is known to further widen this band by combining the antenna with a tuning unit, known as an Antenna Tuning Unit; this tuning unit has the role of providing perfect impedance matching throughout the working band.

Figure 2A:
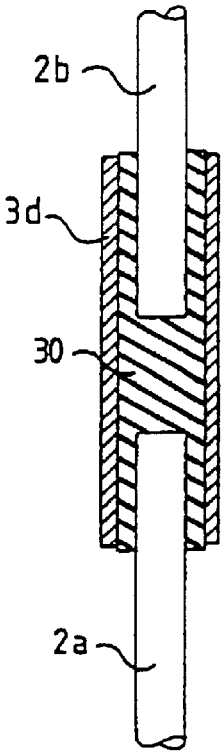
PRIOR ART FIG.2a
Figure 2B:
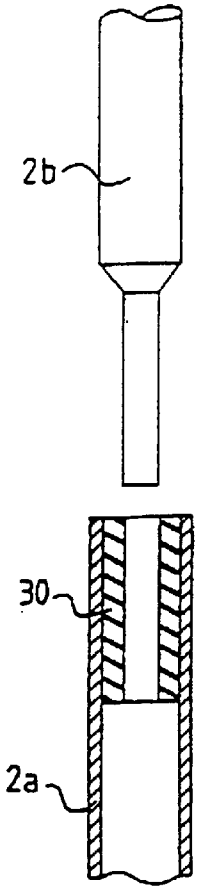
PRIOR ART FIG.2b
Figure 2C:
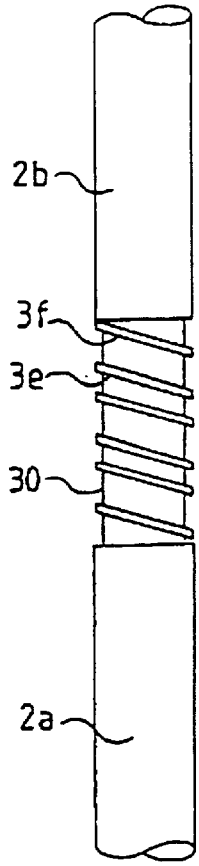
PRIOR ART FIG.2c

It is known to produce a whip-type antenna with capacitive loads in different ways, which will be illustrated with the aid of FIGS. 2*a*, 2*b*, 2*c* attached and of the description relating to them.

However, these embodiments do not give entire satisfaction since either the antenna is relatively fragile in the region of the capacitive load, or a mechanical reinforcement has to be provided at this spot, which renders manufacture expensive.

The U.S. Pat. No. 4,958,164 describes a dismantling-type antenna which operates in the wideband domain. It consists of several linear radiating elements arranged in series, one of which includes a capacitor.

In the U.S. Pat. No. 5,836,072, there is described a method for assembling an antenna, and more particularly the manner of coating the elements of an antenna with a thermoplastic material.

The object of the present invention is to avoid or, at least, to reduce these drawbacks.

This is achieved principally by virtue of a specially designed capacitive load, arranged so as not to weaken the antenna.

According to the invention, a dismantling-type antenna is therefore proposed, with a capacitive load, of whip type, including several radiating segments separate from one another and arranged end to end one after the other, each segment including a conducting stretch which extends over the whole length of the segment, characterized in that at least one of the segments includes a capacitive load, inserted integrally into its conducting stretch, and a hollow insulating tube which serves as a support for the conducting stretch and within which the capacitive load is housed, in that the capacitive load includes a first armature consisting of a metal enclosure, a second armature consisting of a length of a conducting wire covered with an insulating sheath, this length of wire being located in the enclosure and at least one of its ends being situated at the limit of the enclosure and being extended out of the enclosure so as to constitute an access to the second armature.

According to the invention, a method is also proposed for manufacturing a radiating segment of a dismantling-type antenna, with a capacitive load, of whip type, characterized in that it includes at least the following stages:

arranging a ferrule around a support, such as a mandrel, including a first and a second end, pushing in the capacitive load including a metal block and a metal wire, at a first end of the said support, arranging a conducting element around the said mandrel, such as a braid secured to the two ends of the support, surrounding the assembly thus formed with a protective means, such as a protective envelope made of glass-fibre reinforced plastic, the said protective means extending between the outlet wire from the load and the second end of the support, subjecting the assembly to a hardening stage, withdrawing the support element.

Figure 1A:
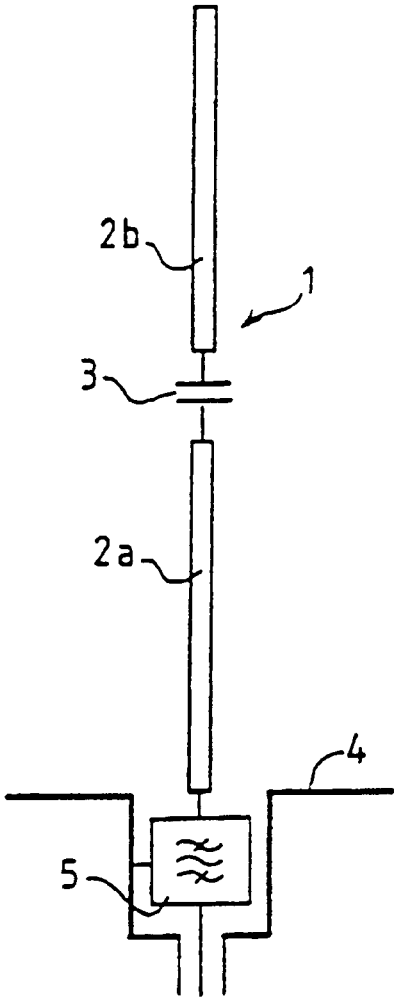
Figure 1B:
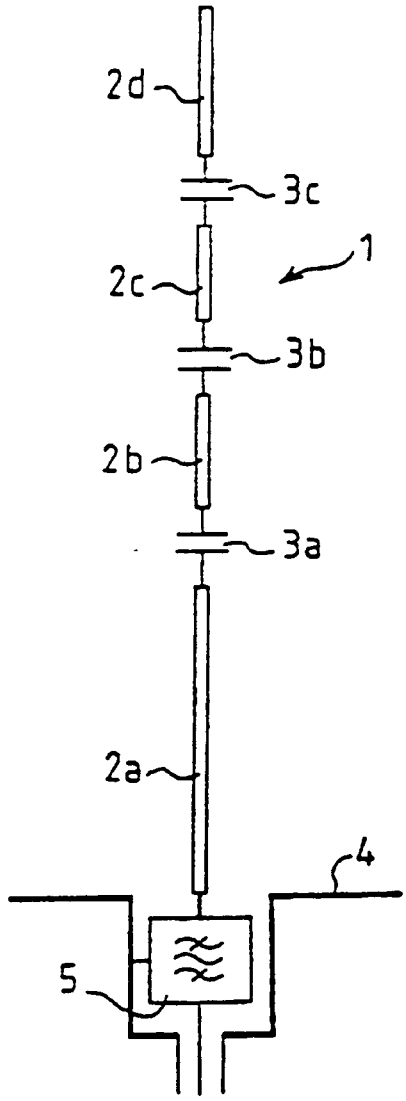
Figure 3:
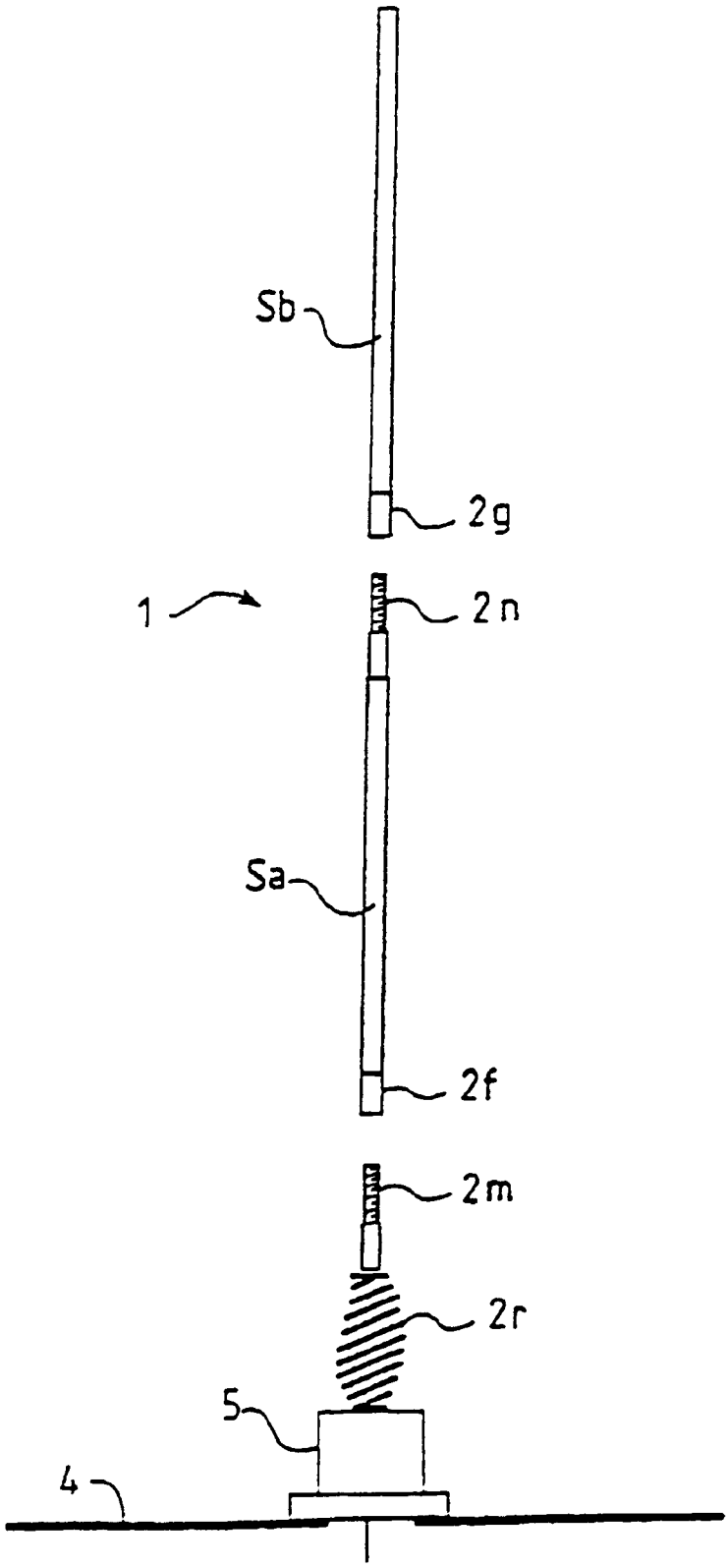
Figure 4A:
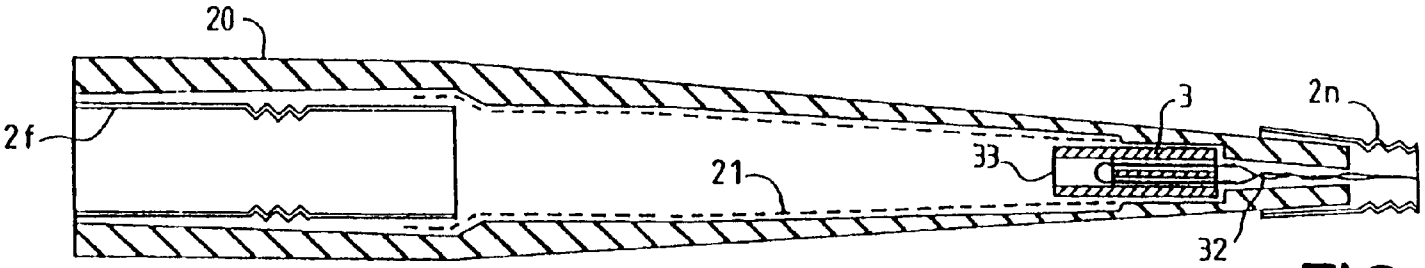
Figure 4B:
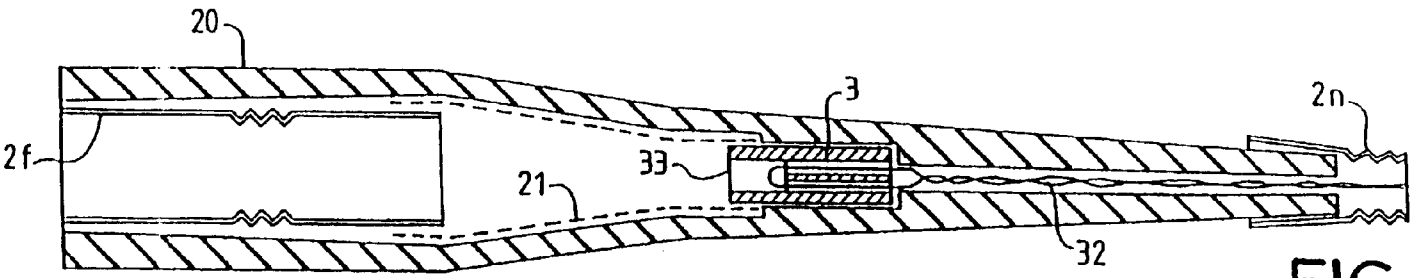
Figure 4C:
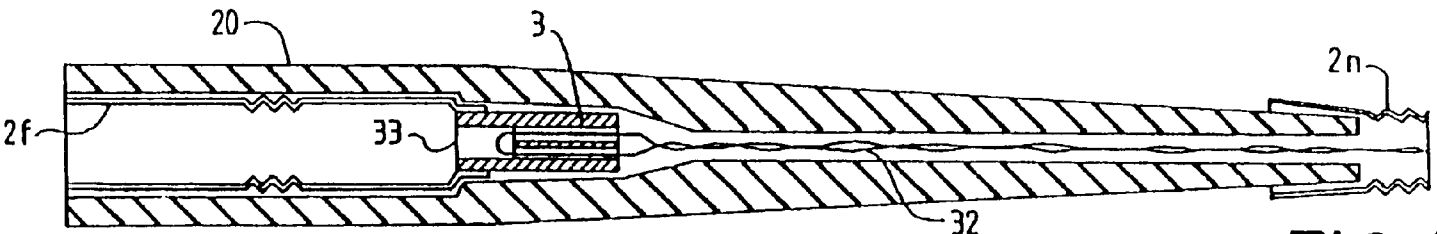
Figure 5A:
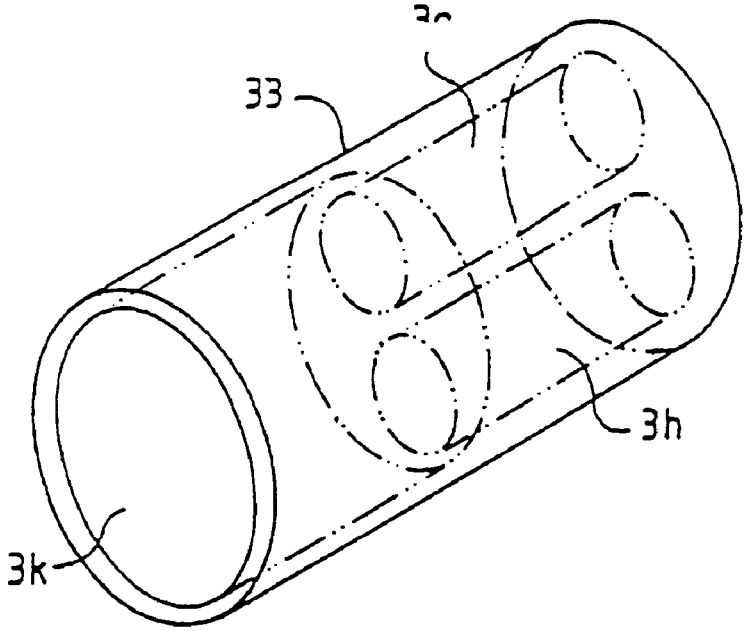

The present invention will be better understood and other characteristics will emerge with the aid of the description below and of the figures relating to it, which represent:

FIGS. 1*a*, 1*b*, diagrams of whip antennae,

FIGS. 2*a*, 2*b*, 2*c*, parts of whip antennae according to the prior art, FIG. 3, a dismantling-type whip antenna, FIGS. 4*a*, 4*b*, 4*c*, sectional views of elements of whip antennae according to the invention, FIG. 5*a*, a component part used in the antennae according to FIGS. 4*a*, 4*b* and 4*c*, FIG. 5*b*, two components parts, including the one according to FIG. 5*a*, as they are combined in the antennae according to FIGS. 4*a*, 4*b*, 4*c*, FIGS. 6*a* to 6*d*, diagrams which illustrate various stages of the assembly of the antenna element according to FIG. 4*a*.

On the various figures, the corresponding elements are designated by the same identifiers.

For issues of understanding of the drawing, the proportions have not always been obeyed, in particular in FIGS. 4 and 6. in By wideband antenna should be understood, in the rest of the text, an antenna the operating band of which covers more than one octave. In order to design a whip-type antenna, for example for a vehicle and in the 30–88 MHz band, it is usual to adopt, as radiating structure, a wire-like unipole with at least one capacitive load, and to connect this unipole with a tuning unit designed to provide perfect impedance matching throughout the working band; the tuning unit can be likened to a bandpass filter.

FIG. 1 is a diagram of a wideband whip antenna 1. This antenna includes a vertical unipole consisting of the series arrangement of a first conducting stretch 2*a*, of a capacitive load 3 and of a second conducting stretch 2*b*. The antenna 1 also includes a tuning unit 5, arranged between the antenna access and the lower end of the conducting stretch 2*a*, at the bottom of the unipole.

The antenna 1 is mounted, for use, on an earth plane 4, also called counterweight, which consists, for example, of the metal roof of a vehicle.

FIG. 1*b* is another diagram of a wideband whip antenna 1. This antenna, with its vertical unipole and its tuning unit 5, is mounted on an earth plane 4; it is distinguished from the antenna according to FIG. 1*b* by the composition of its unipole which includes, in series from the tuning unit 5; a first conducting stretch 2*a*, a first capacitive load 3*a*, a second conducting stretch 2*b*, a second capacitive load 3*b*, a third conducting stretch 2*c*, a third capacitive load 3*c* and a fourth conducting stretch 2*d*.

Various ways of producing these capacitive loads in whip antennae are known; they are illustrated by FIGS. 2*a*, 2*b*, 2*c* in which two conducting stretches 2*a*, 2*b* which are arranged in the extension of one another are coupled by a capacitive load which is arranged at the site where the two stretches can be detached from one another, the capacitive load being constituted only when the two stretches in question are assembled end to end.

In the case of FIG. 2*a*, the capacitive load requires a dielectric 30 and a metal sleeve 3*d*: the dielectric isolates the conducting stretches 2*a*, 2*b* of which it covers the opposing ends while the sleeve 3*d* surrounds the dielectric. The capacitive coupling between the stretches 2*a*, 2*b* is effected partly directly via the dielectric and partly via the dielectric, the (4 metal sleeve and the dielectric again, successively.

In the case of FIG. 2*b* the conducting stretch 2*a* is hollow and a hollow cylinder made of dielectric, 30, is inserted into the stretch 2*a*, at the upper end of it. The conducting stretch 2*b* has a cross-section in the region of its lower end which corresponds to the internal cross-section of the hollow cylinder; it can thus be threaded into this cylinder so that a capacitive load is produced between the ends of the two stretches 2*a*, 2*b* which are separated by the dielectric of the cylinder 30. In FIG. 2*b*, the stretch 2*b* is represented before being pushed into the hollow cylinder 30.

In the case of FIG. 2*c*, the capacitive load is obtained by coupling between two conducting wires 3*e*, 3*f* wound onto an insulating cylinder 30; the cylinder 30 has two ends which are integral respectively with the stretches 2*a* and 2*b*; the wires 3*e*, 3*f* are soldered respectively, at one of their ends, to the stretches 2*a*, 2*b* and have their other end free, moreover the wires 3*e*, 3*f* are insulated from one another.

In practice, the whips with capacitive loads of the same type as the loads according to FIGS. 2*a*, 2*b* or 2*c* exhibit several drawbacks. This is because the insulating element 30, in these loads, has to fulfil a double role: a radio-frequency role in contributing directly, as a dielectric, to the value of the capacitive load, and a mechanical role in contributing to the mechanical strength of the whip. However, for whips with a height of 2.5 to 3 m, the mechanical stresses can be very severe, which requires mechanical reinforcements in the region of the capacitive loads and increases the cost price of the antenna.

An overall view of a dismantling-type whip antenna is represented in FIG. 3 with a whip and a tuning unit 5 installed diagrammatically on an earth plane 4 which may be the metal bodywork of a vehicle. In the example represented, the whip can be dismantled into two radiating segments separate from one another Sa, ti Sb; the dismantling takes place by virtue of a male threaded ferrule 2*n*, situated at the upper end of the lower segment Sa and of a corresponding female threaded ferrule 2*g*, situated at the lower end of the segment Sb. The segment Sa includes a female ferrule at its lower end. The electrical link between the whip and the tuning unit is made via a male, threaded, linking piece 2*m* and a damping spring 2*r*; in FIG. 3 the piece 2*m* and the spring 2*r* are represented before the piece 2*m* has been made integral with the spring 2*r* by forcible insertion; the piece 2*m* and the damping spring usually form an integral part of the tuning unit.

The antenna which has served as an example for FIG. 3 is an antenna according to the invention with a capacitive load arranged integrally in the segment Sa and not, as in the examples according to FIGS. 2*a*, 2*b*, 2*c*, with a capacitive load arranged at the site where the stretches 2*a* and 2*b* can be detached from one another.

FIGS. 4*a*, 4*b*, 4*c* are three views in longitudinal section of the segment Sa of FIG. 3 corresponding respectively to three different positioning heights of the capacitive load within the radiating segment Sa. In these figures, as elsewhere in FIGS. 5 and 6, the proportions have not been obeyed for reasons of understanding of the drawing. Thus, for example, the conducting stretches according to FIG. 4 measure 1.30 metre in length, including 1 metre of length for their conical part, and amount to only 15 mm at their widest, and the ferrules 2n have a total length of 9 cm with a threaded part on only 2 cm of this length.

The segments according to FIGS. 4*a*, 4*b*, 4*c* include a support consisting of a long insulating hollow tube 20, terminating in two metal ferrules 2*f*, 2*n*, and the conducting stretch consists of the two ferrules it and of an electrical link with capacitive load 3 between the two ferrules. In these implementations according to FIG. 4, it is the insulating hollow tube which provides the mechanical strength of the segment; it consists of glass-fibre-reinforced plastic and the load 3 is housed within this hollow tube.

Figure 5B:
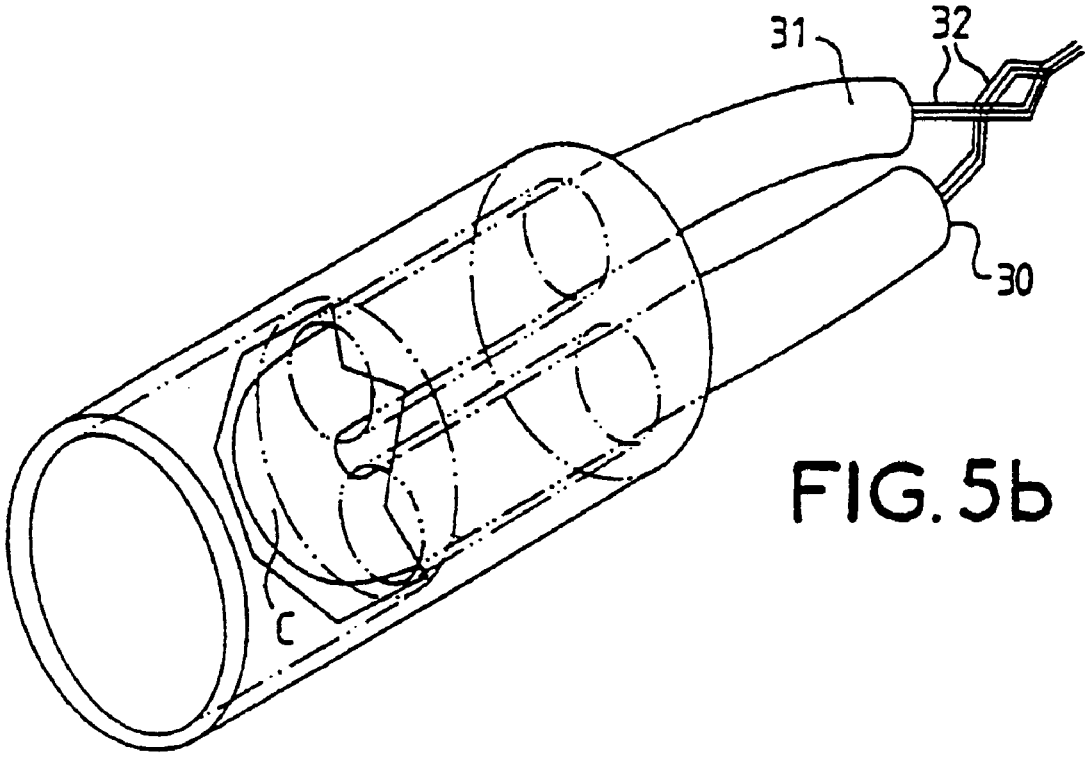

FIGS. 5*a*, 5*b* show how the capacitive load 3 is formed in the examples which are represented in figures 4. This load includes a metal block 33 represented alone and as if it were transparent, in FIG. 5*a*; this block consists of a right cylinder, with a large cylindrical hole 3*k*, which opens out in one of the bases of the right cylinder, and two small cylindrical holes, 3*g*, 3*h*, which open out into the other of the bases of the right cylinder; the three holes are parallel to the large axis, not represented, of the right cylinder and the small holes open out into the large hole, substantially at equal distances from the two bases of the right cylinder.

As FIG. 5*b* shows, an electrical cable 31 consisting of a conducting wire 32 and of an insulating sheath 30 enters into the hole 3*g*, describes a bend, C, within the hole 3*k* and comes out of the block by passing through the hole 3*h*. In the same way as in FIG. 5*a*, the block 33 has been drawn as if it were transparent; furthermore, a cutaway in the wall of the block makes it possible to see the cable 31 better in the region of its bend. The wire 32 of the cable 31 is covered by its insulating sheath only in its part situated within and in the immediate vicinity of the block 33, beyond that the two stripped wires are twisted round one another and the end of this twist is soldered into the ferrule 2*n* as is apparent in FIG. 4.

In the example of capacitive load described, the block 33 is made of brass, it has a length of 1 cm and a diameter of 5 mm; the two holes 3*g*, 3*h* have a diameter of 1.5 mm and a length of 6 mm.

If In this capacitive load the block 33 constitutes one of the armatures while the wire 32, in its part situated within the block, constitutes the other armature.

Figure 6A:
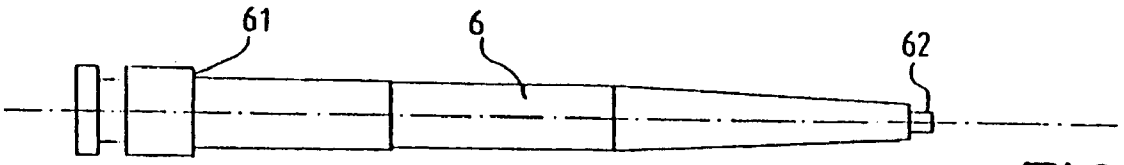
Figure 6B:
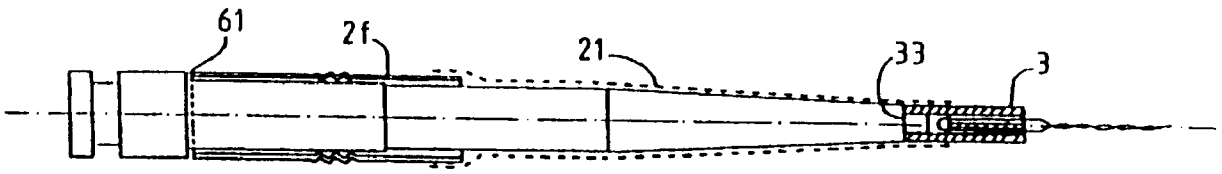
Figure 6C:
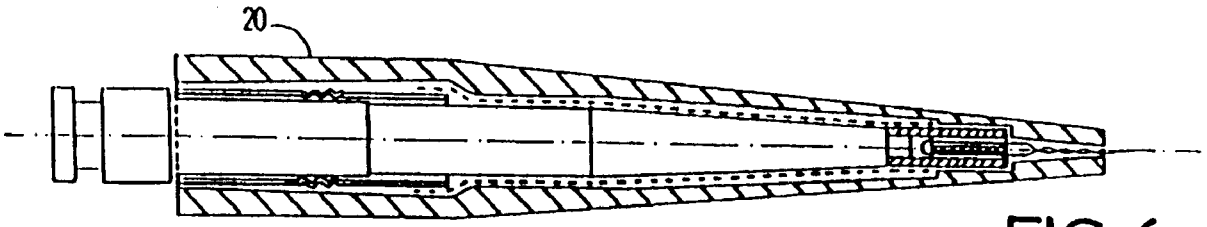
Figure 6D:
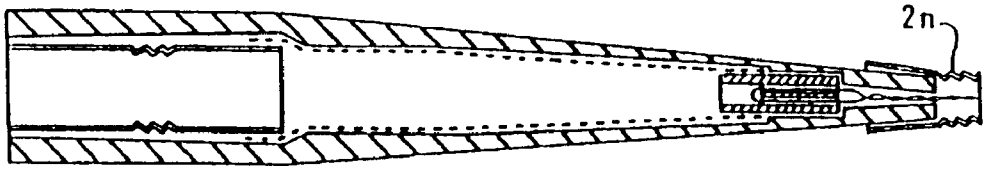

The hole 3*k* has a double role: it stabilizes the value of the capacity of the load by cancelling out the edge effect generated by the bend loop, and it facilitates the positioning of the block 33 in the radiating segment, as will become apparent during the description of FIGS. 6*b*, 6*c*, 6*d*. However, in a variant, the block 33 may not include a hole 3*k*, the holes 3*g*, 3*h* extending over the entire length of the block 33 and the bend occurring outside the block.

In another variant the large hole 3*k*, according to FIG. 5, can be closed by a plug or a metal cover; this results in a slight improvement in the stabilization of the value of the capacity of the load and a slight increase in the cost of the load.

In a variant, likewise, the metal block 33 may take a form other than that of a right cylinder, it being understood that it is necessary for it to constitute a metal enclosure into which the insulated part of an electrical cable penetrates; it is even possible for the cable to have one of its ends situated in the metal enclosure and/or for the cable to be sheathed over practically its entire length.

In the embodiment according to FIG. 4*a*, the capacitive load 3, housed in the insulating hollow tube 20, is situated in the vicinity of the ferrule 2*n*; it is linked to the ferrule 2*f* by a tubular metal braid 21 which is pressed onto the inner wall of the hollow tube. Here, the conducting stretch goes from the ferrule 2*f* to the ferrule 2*n*, passing successively through the metal braid 21, through the capacitive load 3 and through the stripped and twisted part of the outlet wire from the load 3.

In the embodiment according to FIG. 4*b*, the capacitive load 3 is housed substantially at middistance from the ends of the radiating segment and the electrical link between the two ferrules includes the same succession of elements as in the embodiment according to FIG. 4*a*; in contrast, the length of the metal braid 21 is shorter by half than in the example according to FIG. 4*a*, and the length of the stripped and twisted part of the outlet wire from the load 3 changes from about ten centimetres to about fifty centimetres.

In the embodiment according to FIG. 4*c*, the capacitive load 3 is in direct contact with the ferrule 2*f* into which it is set. Here, the electrical link between the two ferrules 2*f*, 2*n* is therefore reduced to two elements: the load 3 and the stripped and twisted part of the outlet wire from the load.

FIG. 6 are diagrams which illustrate a way of producing the conducting stretch according to FIG. 4*a*.

FIG. 6*a* represents a mandrel consisting of a rod length 6, with symmetry of revolution about an axis, with, at one end, a shoulder which forms an abutment 61 and, at the other end, a tenon 62. This mandrel features a frustoconical part the smaller base of which is placed beside the tenon 62 and the total length of which is one metre; this length of the frustoconical part, compared to the total length of the mandrel which is 1.3 m, shows that the proportions have not been obeyed for the purpose, as indicated above, of making the drawing easier to understand.

A ferrule 2*f* is threaded onto the mandrel 6 and comes into contact with the abutment 61. A capacitive load 3 of the same type as the load according to FIG. 5*b* is fitted over the tenon of the mandrel; the block 33 of the load, with its large hole, plays the part of mortise in this fitting. Then a segment of tubular braiding made of tinned copper wires 21 is pushed over the mandrel and soldered at its two ends, respectively onto the ferrule 2*f* and onto the block 33 of the load 3; it is this braid 21 which requires the mandrel to be present in order to prevent it being deformed during the coating operation which will be discussed below.

The mandrel equipped according to FIG. 6*b* is ready to receive a protective envelope of glass-fibre reinforced plastic, in order to form the insulating hollow tube 20 which was discussed during the description of FIG. 4*a*. This takes the form of a lateral coating which goes from the outlet wire from the load 3 as far as the level of the abutment 61 of the mandrel. In order to carry out this coating, various techniques can be employed, for example the techniques which rely, as the coating material, on glass fibres or on glassfibre fabric, these coating materials being preimpregnated beforehand with a thermosetting resin; among the known techniques should be noted: the winding of glass fibres, the operation of rolling with a glassfibre fabric, the technique of continuous deposition of glass fibres with a machine commercially available under the registered trademark SPIRGLASS. The assembly thus covered with its tube 20 is represented in FIG. 6*c*.

After thermosetting, the mandrel can be removed; the element thus obtained is machined in order to be set to the exact length desired and in order to make it possible to cap it with a ferrule 2*n* which is bonded onto the insulating tube 20. It then remains to solder the outlet wire from the load 3 onto the ferrule 2*n* in order to complete the manufacturing of the radiating segment. FIG. 6*d* represents this completed segment, seen in longitudinal section. In this figure, as elsewhere in FIG. 4 and in FIGS. 6*b* and 6*c*, the tube 20 has been drawn slightly detached from the ferrules, from the capacitive load, from the outlet wire from the load and from the braid where it exists; this representation was wanted in order better to distinguish the constituent elements of the conducting stretch but in reality, needless to say, the tube 20 is pressed tightly over the elements which it envelops.

FIG. 6 deal with the method of manufacturing a radiating segment according to FIG. 4*a*. These figures can be adapted to the manufacture of a segment according to FIGS. 4*b* and 4*c* respectively, by using a shorter mandrel and by using no mandrel; this is because the role of the mandrel is to support the metal braid where it exists, during the deposition of glassfibre reinforced plastic.

The present invention is not limited to the examples described or mentioned above; thus, in particular, various assembly means can be employed to replace the screw-type ferrules for assembling the radiating elements end to end one after the other: smooth tubes nesting into one another, bayonet systems, assembly by clipping, etc., or the ferrules can even, for example, be replaced by plates and the link between two successive segments can be formed by placing the plates side by side in the region of the junction and by fixing them to one another by means of the nut and bolt type.

The present invention is more particularly intended for antennae for mobile stations, whether these stations are mounted on a vehicle or are of the portable type.

What is claimed is:

1. Dismantling-type antenna, with a capacitive load, of whip type, including several radiating segments separate from one another and arranged end to end one after another, each segment including a conducting portion which extends over a whole length of the segment, wherein at least one of the segments includes a capacitive load, inserted integrally into its conducting portion, and a hollow insulating tube which serves as a support for the conducting portion and within which the capacitive load is housed, the capacitive load including a first armature including a metal enclosure, a second armature including a length of a conducting wire covered with an insulating sheath, the length of conducting wire being located in the metal enclosure and at least one of its ends being situated at a limit of the metal enclosure and extended out of the metal enclosure so as to constitute an access to the second armature.

2. Antenna according to claim 1, wherein the metal enclosure includes a block of metal holed along a given path, and the length of conducting wire is arranged along the given path.

3. Antenna according to claim 1, wherein the conducting wire is a twisted wire each of ends of which situated at the limit of the metal enclosure and extended out of the metal enclosure in order to constitute an access to the second armature.

4. Antenna according to claim 1, wherein the capacitive load is arranged in a vicinity of a ferrule and linked to the ferrule by means of a tubular metal braid pressed onto a wall of the hollow tube.

5. Antenna according to claim 1, wherein the capacitive load is housed substantially at mid-distance from the two ends of the radiating segment.

6. Antenna according to claim 1, wherein the capacitive load is in direct contact with a ferrule.

7. Method for manufacturing a radiating segment of a dismantling-type antenna, with a capacitive load, of whip type, comprising:

arranging a ferrule around a support, such as a mandrel, including a first and a second end, pushing in the capacitive load including a metal block and a metal wire, at a first end of the said support, arranging a conducting element around the mandrel, such as a braid secured to the two ends of the support, surrounding the assembly thus formed with a protective means, such as a protective envelope made of glass-fibre reinforced plastic, the protective means extending between the outlet wire from the load and the second end of the support, subjecting the assembly to a hardening stage, and withdrawing the support element.

* * * * *

UNITED STATES PATENT AND TRADEMARK OFFICE

CERTIFICATE OF CORRECTION

PATENT NO. : 6,404,396 B1
DATED : June 11, 2002
INVENTOR(S) : Hung et al.

It is certified that error appears in the above-identified patent and that said Letters Patent is hereby corrected as shown below:

Title page,
Items [22], [86] and [87] have been omitted. Item [22] and the PCT information should read as follows:

-- [22] PCT filed: Mar. 7, 2000
[86] PCT No.: PCT/FR00/00565

§371 (C)(1),
(2), (4) Date: Sep. 10, 2001

[87] PCT Pub. No.: WO00/55940
PCT Pub. Date: Sep. 21, 2000 --

Signed and Sealed this

Seventeenth Day of December, 2002

JAMES E. ROGAN
*Director of the United States Patent and Trademark Office*